United States Patent [19]

Petkovic

[11] Patent Number: 4,620,433

[45] Date of Patent: Nov. 4, 1986

[54] WIRE COOLING APPARATUS FOR A WIRE DRAWING MACHINE

[75] Inventor: Dominique Petkovic, Chelles, France

[73] Assignee: Office Technique des Trefiles, Chelles, France

[21] Appl. No.: 743,961

[22] Filed: Jun. 12, 1985

[30] Foreign Application Priority Data

Jun. 15, 1984 [FR] France ..... 84 09426

[51] Int. Cl.[4] ..... B21C 9/00

[52] U.S. Cl. ..... 72/286

[58] Field of Search ..... 72/44, 45, 286

[56] References Cited

U.S. PATENT DOCUMENTS 883,695 4/1908 Canda ..... 72/286
3,747,388 7/1973 Hagen ..... 72/286
3,774,436 11/1973 Tuiksta ..... 72/286
4,214,470 7/1980 Hurst ..... 72/286

*Primary Examiner*—Leon Gilden
*Attorney, Agent, or Firm*—Wenderoth, Lind & Ponack

[57] ABSTRACT

A cooling apparatus for a wire drawing machine including a capstan applying a pulling action on a wire moving through a die and around which the drawn wire is wound, forming turns, includes a caisson in the shape of a circular sector and of tubular section, positioned in the vicinity of the capstan. The caisson is supplied with a cooling liquid and is arranged in such manner as, on the one hand, to direct the cooling liquid toward the wire turns wound on the capstan, and on the other hand, to collect and discharge the liquid after the cooling operation.

7 Claims, 3 Drawing Figures

WIRE COOLING APPARATUS FOR A WIRE DRAWING MACHINE

FIELD OF THE INVENTION

The present invention relates to a wire cooling apparatus for a wire drawing machine.

The reduction of section of a metallic wire due to a wire drawing operation, that is by being pulled through a die by a winding capstan, generates heat, just as any mechanical deformation process, the effect of which is to increase the temperature of the drawn wire and of the tools in engagement with such wire.

Such an increase of temperature modifies the mechanical characteristics of the wire. Such a modification is all the more detrimental when the drawn wires are made of a steel with a high carbon content, and is the cause of the well known aging phenomena.

This is particularly the case with "dry" type wire drawing machines where the lubricant used for promoting the wire drawing operation is a dry product in powder form performing no cooling action.

DESCRIPTION OF THE PRIOR ART

In order to limit the heating of the wire and to keep it within limits acceptable from the metallurgical viewpoint, modern wire drawing machines are equipped with wire cooling apparatus which are mainly of two types, i.e. a direct cooling apparatus and an indirect cooling apparatus.

The indirect cooling consists in cooling down, by circulating a liquid, the tools in engagement with the wire, that is the die and the pulling capstan. The residence time of an elementary length of wire inside the die being extremely short, such cooling is very limited. On the contrary, the capstan allows storing a large number of turns, thereby increasing the surface of engagement between the hot wire and the cooled capstan. Such a cooling is therefore more efficient but is limited, due to its heat exchange principle on the one hand, and to the purely linear engagement between the round wire and the cylindrical capstan on the other hand.

Direct cooling can be considered alone or as a complement of indirect cooling, and is of two types:

- by air: air blown around the capstan creates an ascending air envelope and cools the wire stored on the capstan. Such a method is frequently used together with the above described inner cooling of the capstan by a liquid. It should be noted that the smaller the diameter of the wire, the larger the cooling efficiency. Such limits are obvious due to the low specific heat of air. The main disadvantages of this procedure are noise and pollution resulting from stirring of the wire drawing soaps and soap residues which are always present on the machine.
- by a liquid: several systems exist and consist in spraying the wire while the wire is moving from a point of die output to the tangency with the capstan cylindrical surface.

Such methods have proven to be only slightly efficient on high speed machines since, taking in account the small space available, the residence time of the wire in the devices practicing such methods is between a few tens and a few hundreds of a second. Moreover, when a wire break occurs, the cooling liquid may eventually flow through the die and mix with the wire drawing soap which is downstream of the die. It should also be noted that such methods generally require providing considerably longer threading lengths and make the threading operation through the machine more delicate.

Another method consists in spraying the cooling liquid from the outside directly on the turns of wire stored on the capstan, thereby providing a longer exposure of the wire to the cooling liquid. Such a method would provide efficient cooling, but the liquid running down and centrifugated and the moist atmosphere surrounding the machine are not acceptable in practice.

The throughput of a wire drawing machine being a function of its speed, wire makers are interested in machines which are increasingly rapid, but since the wire heating is also a function of the speed, the problem encountered is difficult to solve.

SUMMARY OF THE INVENTION

Such a problem is solved, according to the invention, by placing in the vicinity of the lower portion of the capstan, and concentrically to the capstan, a cooling caisson having the shape of a circular sector and of a tubular section, supplied with cooling liquid and arranged in a manner such, on the one hand, as to direct the cooling fluid towards the turns of wire wound on the capstan, on the other hand to collect the fluid, after it has performed its cooling action, in order to discharge it.

According to a feature of the invention, the caisson comprises, facing the capstan, a wall into which opens the cooling liquid supply duct, arranged such as to direct and distribute the cooling liquid within a space forming a cooling zone defined between the wall and the turns of wire wound on the capstan.

According to another feature of the invention, the caisson has, opening into such space forming the cooling zone and on either side of the distribution wall, a collecting and pressure reducing chamber for the cooling liquid projected by pressure and centrifugal force after its cooling action, and of steam produced by the cooling operation, for their discharge via piping provided on the caisson and advantageously connected to a suction system.

According to still another feature of the invention, the caisson is mounted such that it is possible to modify its spacing from the machine capstan.

Thus, and in order that the initial filling of the capstan with wire be more easy, the caisson is moved away from the machine, manually or by any other means such as a jack, etc., while during a wire drawing operation effected by the machine, the caisson is maintained spaced from the capstan by a distance sufficient for the wire turns wound on the capstan not to come into contact with the caisson. Thus there is formed a thin sheet of cooling liquid between the wire turns and the distribution wall of the caisson. A judicious adjustment of the supply and suction flow rates as well as the pumping effect caused by the rotation of the rotating capstan opposite the fixed caisson avoid side leakage of the liquid.

The various features and advantageous of the invention will become more apparent from the following description of one of its possible embodiments. Obviously, this is only an example and other arrangements could also be adopted without departing from the scope of the invention.

BRIEF DESCRIPTION OF THE DRAWINGS

In the following description, reference is made to the accompanying drawings in which.

DETAILED DESCRIPTION OF THE INVENTION

Figure 1:
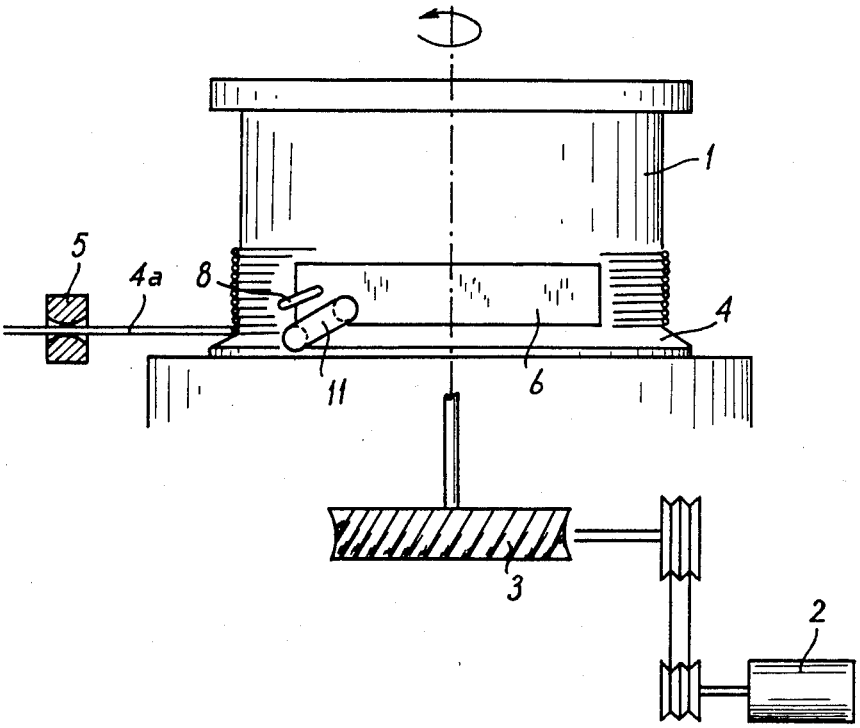
FIG. 1 is a schematic elevation view of a wire drawing machine provided with an apparatus according to the invention.
Figure 2:
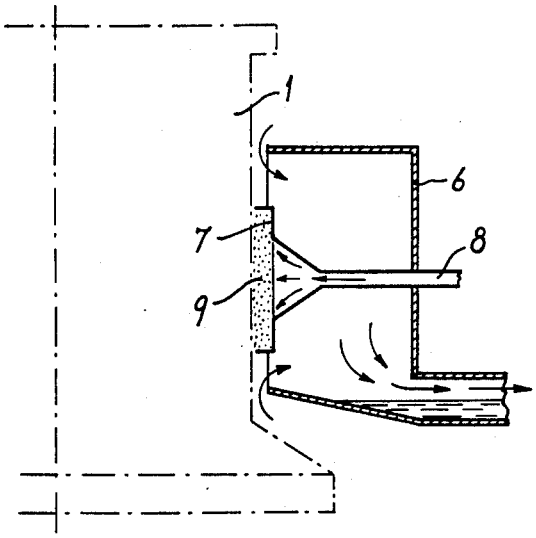
FIG. 2 is a sectional view of the apparatus at a larger scale and through a plane transverse to that of FIG. 1.
Figure 3:
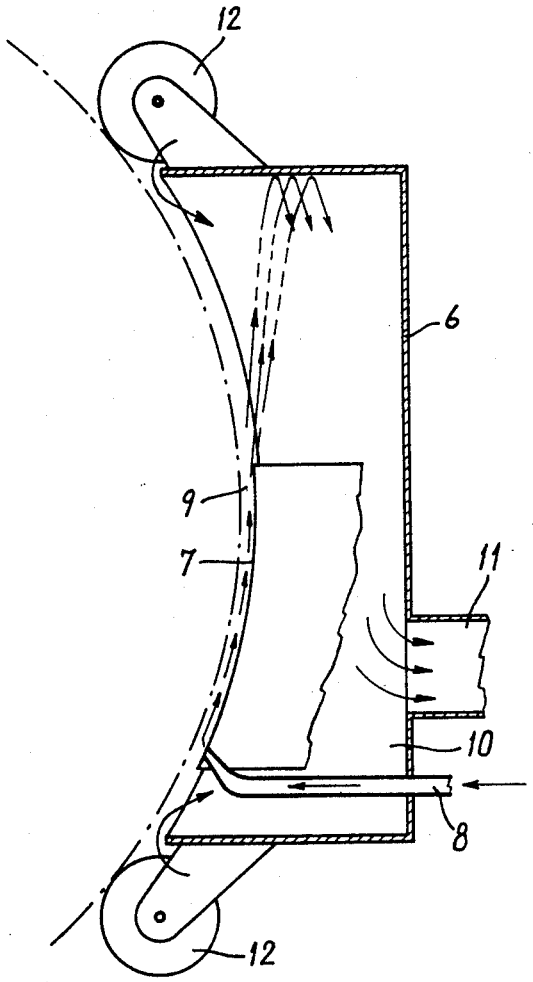
FIG. 3 is a plan view of the apparatus.

As seen in FIG. 1, a wire drawing machine includes a capstan 1 having the shape of a cylindrical body driven in rotation by a motor 2 and a transmission 3. An inner portion 4 of capstan 1 pulls wire 4*a* through die 5 positioned upstream with respect to the direction of movement of the wire. Several turns of the wire are formed on the capstan by the operator when threading the machine in order to obtain the capstan effect which is necessary for the wire drawing operation and to cover a cooling area on the capstan. As the wire drawing proceeds, the turns of wire accumulate upwardly along the capstan before reaching a downstream wire drawing block, when the machine is of the multiple wire drawing type, or a wire take-up apparatus when the machine is the last block of a multiple block machine or a unitary wire drawing machine.

According to the invention, a housing or caisson 6 in the shape of a circular sector and of tubular section is mounted in the vicinity of the lower portion of capstan 1 and concentrically, thereto. The caisson has, on a face turned directed toward the capstan, a wall 7 to which cooling liquid is transported by one or several ducts 8. Wall 7 is arranged such as to direct the cooling liquid toward a space 9 formed between the wall 7 and the turns of the wire wound on capstan 1, and to distribute the liquid within space 9.

Distribution wall 7 has a height such that a sufficient number of wire turns is subjected to the direct cooling effect of the thin sheet of liquid introduced inside space 9, thus forming a cooling zone.

The caisson has, opening into space 9, on either side of distribution wall 7, a collecting and pressure reducing chamber 10 inside which are projected, by pressure and centrifugal force, liquid which has been used for cooling and steam generated during such cooling. Such cooling residues are discharged via a pipe 11 advantageously connected to a suction system (not shown).

The caisson is mounted in such a manner that its position with respect to the capstan can be modified, for example in order to move it away from the capstan when threading the machine.

Moreover, if due to an incorrect disposition of the wire turns on the capstan there should occur a wire crossing upstream of the caisson, a means such as a roller 12, a lug or a finger rigidly connected to the caisson causes movement of the caisson away from the wire turns in order to avoid contact between the wire and the caisson.

Obviously, this invention is in no way limited to the embodiment described and shown and can be accomplished in many alternative embodiments without departing from the scope of the invention as defined in the appended claims.

What is claimed is:

1. A cooling apparatus for use with a wire drawing machine including a die and a capstan for drawing a wire through the die, thereby heating the wire, and for winding turns of the thus drawn wire around the periphery of the capstan, said cooling apparatus comprising:

a housing adapted to be mounted adjacent the periphery of the capstan, said housing having a configuration facing the capstan substantially complementary to the periphery of the capstan;

means for supplying a cooling liquid through said housing and directing said cooling liquid directly against wire turns on the periphery of the capstan, thereby cooling the wire turns; and means for collecting said cooling liquid into and through said housing after said cooling liquid has cooled the wire turns.

2. An apparatus as claimed in claim 1, wherein said housing has wall means, facing the wire turns on the capstan, defining with the wire turns a space forming a cooling zone, for directing said cooling liquid toward the wire turns and for distributing said cooling liquid within said space.

3. An apparatus as claimed in claim 2, wherein said supplying means comprises at least one pipe extending through said housing and opening at said wall means into said space.

4. An apparatus as claimed in claim 2, wherein said collecting means comprises a chamber within said housing and connected to said space on opposite sides of said wall means, whereby cooling fluid after cooling the wire turns and steam producing during such cooling operation are projected by pressure and centrifugal force into said chamber, and discharge duct means connected to said chamber and adapted to be connected to a suction system for discharging the thus collected cooling liquid and steam from said chamber.

5. An apparatus as claimed in claim 2, wherein said wall has a height sufficient to direct said cooling fluid against a plurality of wire turns.

6. An apparatus as claimed in claim 1, further comprising means for mounting said housing for adjustment of the spacing between said housing and the capstan.

7. An apparatus as claimed in claim 1, further comprising means for mounting said housing for moving said housing away from the capstan upon the passage therebetween of an oversize portion of the wire.

* * * * *